US010490011B2

(12) United States Patent
Liang et al.

(10) Patent No.: US 10,490,011 B2
(45) Date of Patent: Nov. 26, 2019

(54) FLATTENING DEVICE AND FINANCIAL SELF-SERVICE EQUIPMENT

(71) Applicant: GRG BANKING EQUIPMENT CO., LTD., Guangzhou, Guangdong (CN)

(72) Inventors: Tiancai Liang, Guangdong (CN); Chengye Zhang, Guangdong (CN); Daoyu Liu, Guangdong (CN); Fei Zhao, Guangdong (CN); Minjie Fang, Guangdong (CN)

(73) Assignee: GRG BANKING EQUIPMENT CO., LTD., Guangzhou, Guangdong (CN)

( * ) Notice: Subject to any disclaimer, the term of this patent is extended or adjusted under 35 U.S.C. 154(b) by 8 days.

(21) Appl. No.: 15/760,631

(22) PCT Filed: Jun. 6, 2016

(86) PCT No.: PCT/CN2016/084920
§ 371 (c)(1),
(2) Date: Mar. 16, 2018

(87) PCT Pub. No.: WO2017/059689
PCT Pub. Date: Apr. 13, 2017

(65) Prior Publication Data

US 2019/0051081 A1 Feb. 14, 2019

(51) Int. Cl.
*G07D 11/17* (2019.01)
*B65H 5/06* (2006.01)
(Continued)

(52) U.S. Cl.
CPC ..... *G07D 11/175* (2019.01); *B65H 5/062* (2013.01); *B65H 29/125* (2013.01);
(Continued)

(58) Field of Classification Search
CPC ..... B65H 5/062; B65H 29/125; B65H 23/34; B65H 2301/5125; B65H 2301/51256;
(Continued)

(56) References Cited

U.S. PATENT DOCUMENTS 2,988,356 A * 6/1961 Maier ..... B65H 3/24 271/10.04
3,276,773 A * 10/1966 Tiger ..... G03G 15/02 250/325

(Continued)

FOREIGN PATENT DOCUMENTS

CN 2225455 Y 4/1996
CN 201041683 Y 3/2008

(Continued)

OTHER PUBLICATIONS

The Extended European Search Report for the European Patent Application No. 16852997.2, dated Jul. 24, 2018.

(Continued)

*Primary Examiner* — David H Bollinger
(74) *Attorney, Agent, or Firm* — Yue(Robert) Xu; Apex Attorneys at Law, LLP

(57) ABSTRACT

A flattening device includes: a holder configured to support the following components; at least one flattening roller set, including a first flattening roller and a second flattening roller arranged oppositely at two sides of a sheet medium conveying path; and a power mechanism configured to drive the first and second flattening rollers to rotate. A surface of the first flattening roller is distributed with n arc-shaped grooves arranged in parallel with an axis direction of the first flattening roller, wherein n is a natural number greater than or equal to 1; and a surface of the second flattening roller is provided with at least one arc-shaped protruding portion in rolling engagement with the arc-shaped grooves of the first flattening roller; and wherein, the first flattening roller and
(Continued)

the second flattening roller are in rolling engagement to form a conveying passage for the sheet medium.

16 Claims, 7 Drawing Sheets

(51) Int. Cl.
*B65H 29/12* (2006.01)
*G07D 11/175* (2019.01)

(52) U.S. Cl.
CPC ..... *B65H 2301/5125* (2013.01); *B65H 2301/51256* (2013.01); *B65H 2404/1115* (2013.01); *B65H 2404/1415* (2013.01); *B65H 2701/1912* (2013.01)

(58) Field of Classification Search
CPC .... B65H 2404/1115; B65H 2404/1415; B65H 2701/1912; G07D 11/175
USPC ..... 271/272
See application file for complete search history.

(56) References Cited

U.S. PATENT DOCUMENTS

| | | | |
|---|---|---|---|
| 4,326,915 | A | 4/1982 | Mutschler, Jr. |
| 10,214,376 | B2 | 2/2019 | Chang et al. |
| 2010/0221052 | A1 | 9/2010 | Mizuno et al. |
| 2019/0026969 | A1 | 1/2019 | Lai |

FOREIGN PATENT DOCUMENTS

| | | | |
|---|---|---|---|
| CN | 201224632 | Y | 4/2009 |
| CN | 102426718 | A | 4/2012 |
| CN | 202795548 | U | 3/2013 |
| CN | 202854946 | U | 4/2013 |
| CN | 103886675 | A | 6/2014 |
| CN | 203950382 | U | 11/2014 |
| CN | 104444519 | A | 3/2015 |
| CN | 105160760 | A | 12/2015 |
| EP | 2865626 | A1 | 4/2015 |
| GB | 191512721 | A | 8/1916 |
| GB | 2063225 | A | 6/1981 |
| JP | 2001139198 | A | 5/2001 |
| JP | 2011057398 | A | 3/2011 |

OTHER PUBLICATIONS

The 1st Office Action dated Mar. 15, 2019 with the English Summary for Chilean Application No. 2018-000870.
International Search Report for PCT/CN2016/084920, dated Aug. 26, 2016, ISA/CN.

* cited by examiner

FLATTENING DEVICE AND FINANCIAL SELF-SERVICE EQUIPMENT

This application is the national phase of International Application No. PCT/CN2016/084920, titled "FLATTENING DEVICE AND FINANCIAL SELF-SERVICE EQUIPMENT", filed on Jun. 6, 2016, which claims the priority to Chinese Patent Application No. 201510648679.X titled "FLATTENING DEVICE AND FINANCIAL SELF-SERVICE EQUIPMENT", filed with the Chinese State Intellectual Property Office on Oct. 9, 2015, the entire disclosures thereof are incorporated herein by reference.

FIELD

The present application relates to a sheet-like medium processing technology, and particularly relates to a device used in a financial self-service equipment to effectively flatten curled banknotes.

BACKGROUND

At present, banknote boxes in financial self-service equipment (such as ATM) can be classified into stack-type banknote boxes and drum-type banknote boxes according to different ways in which banknotes enter and leave the banknote boxes. Drum-type banknote boxes have been applied in circulatory machine cores due to its advantages such as having a small occupation volume, a high reliability of banknotes entering and leaving, and a considerable amount of banknotes deposit and so on. The depositing of banknotes in the banknote box is completed by a reel and a tape, and the banknotes are guided by the tape to wrap around the reel layer upon layer. When the banknotes are discharged, the tape rotates reversely to guide the banknotes to be released from the reel.

When the financial self-service equipment is used less frequently, the banknotes may appear to have a curvature approximate to a diameter of the reel after having been stored in the reel of a drum-type machine core, and especially the banknotes near an inner core of the reel have the largest curvature. Therefore, when discharging and conveying severely curled banknotes, unsmooth conveying and even jamming and tearing of the curled banknotes may easily occur at a turning and direction changing position in a passage; besides, curled banknotes are not conducive to a secondary banknote feeding, because ends of the banknotes are apt to be bent which obstructs the banknotes from entering a banknote entrance, and thus severely affects the reliability of equipment operation and customer experience.

At present, a common method to flatten a banknote is to make the banknote pass through a passage having a bending direction opposite to a direction in which the banknote is bent, to force the banknote to bend and deform reversely, and alleviate a bending and deformation degree of the banknote through time and pressure. However, due to a high transmission speed of banknotes in the financial self-service equipment, the treated banknotes have an unobvious or even no flattening effect; and the efficiency is low, which fails to meet the application requirements of the financial self-service equipment.

SUMMARY

In order to address the technical problem in the conventional technology that curled banknotes cannot be effectively and quickly flattened, a flattening device used to effectively flatten curled banknotes is provided according to the present application, to ensure reliability of the operations such as discharging, conveying and identification of the curled banknotes.

A flattening device according to the present application includes: a holder configured to support the following components; at least one flattening roller set, including a first flattening roller and a second flattening roller arranged oppositely at two sides of a sheet medium conveying path; and a power mechanism configured to drive the first flattening roller and the second flattening roller to rotate; wherein a surface of the first flattening roller is distributed with n arc-shaped grooves arranged in parallel with an axis direction of the first flattening roller, wherein n is a natural number greater than or equal to 1, preferably, the n arc-shaped grooves are arranged in the surface of the first flattening roller with an interval of 360/n between each two adjacent grooves; and a surface of the second flattening roller is provided with at least one arc-shaped protruding portion in rolling engagement with the arc-shaped grooves of the first flattening roller; and wherein, the first flattening roller and the second flattening roller are in rolling engagement to form a conveying passage for the sheet medium.

Preferably, at least one side of two sides of the flattening roller set is provided with a conveying guide roller, a preset differential value is provided between a surface linear velocity of the conveying guide roller and a surface linear velocity of the first flattening roller, and a banknote guiding plate is arranged between the conveying guide roller and the flattening roller set.

Preferably, the surface of the first flattening roller is provided with four of the arc-shaped grooves, the four arc-shaped grooves are evenly distributed, and the second flattening roller is an oval-shaped roller in rolling engagement with the surface of the first flattening roller.

Preferably, the surface of the first flattening roller is provided with four of the arc-shaped grooves, the first flattening roller is provided with four of the arc-shaped protruding portions, and the four arc-shaped protruding portions are in rolling engagement with the four arc-shaped grooves on the surface of the first flattening roller, respectively.

Preferably, a depth of the arc-shaped groove in the surface of the first flattening roller is not be less than a maximum curling amount of the sheet medium.

Preferably, the surface of the first flattening roller and/or the second flattening roller is covered with a rubber layer.

A financial self-service equipment is further provided according to the present application, including:

a banknote inlet/outlet for depositing and/or withdrawing banknotes;

a banknote storage box for storing and discharging the banknotes; and a banknote conveying passage for connecting the banknote inlet/outlet and the banknote storage box and conveying the banknotes;

wherein the flattening device is arranged in the banknote conveying passage.

Compared with the conventional technology, the flattening device according to the present application has the following advantages:

The first flattening roller and the second flattening roller of the flattening device clamp the curled banknotes, making the curved banknotes to form reverse bending deformation, to effectively reduce a curling degree of the banknotes, thereby enhancing reliability and stability of the financial self-service equipment in operations like banknotes transmission, identification and stacking. The device is miniaturized, it is not required to make major changes to original financial self-service equipment, and the device can be arranged as a banknote conveying passage in the machine core.

DETAIL DESCRIPTION

In order to further illustrate the flattening device according to the present application, detailed descriptions are further made hereinafter in conjunction with the drawings of the preferable embodiments according to the present application.

Figure 1:
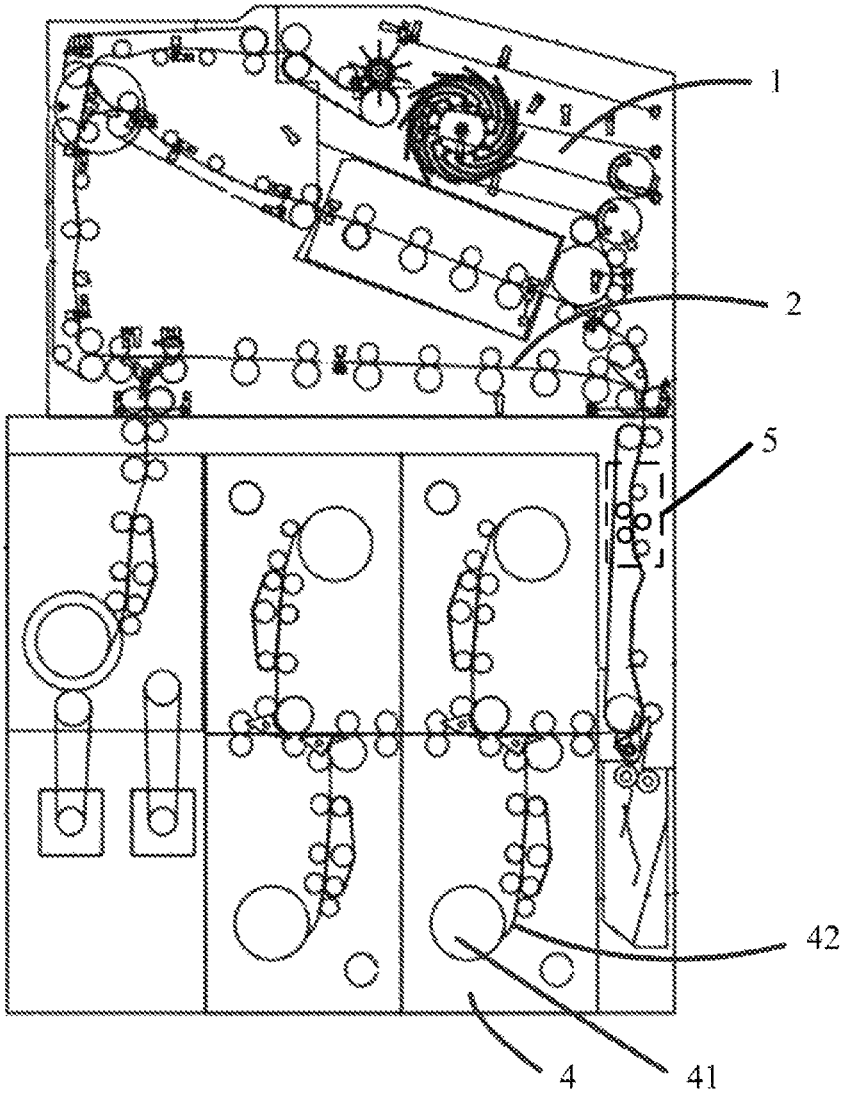
FIG. 1 is a schematic view showing the structure of a financial self-service equipment according to the present application.

As shown in FIG. 1, which is a schematic view showing the structure of a financial self-service equipment according to the present application, and the financial self-service equipment includes a banknote inlet/outlet 1 for depositing and/or withdrawing banknotes, a banknote conveying passage 2, and a banknote storage box 4. The banknote conveying passage 2 is configured to connect the banknote inlet/outlet 1 and the banknote storage box 4 and to convey banknotes. The banknote storage box 4 includes a reel 41 configured to carry the banknotes, and at least a tape 42 configured to wind and bundle the banknotes around a periphery of the reel 41, and the banknotes are guided by the tape 42 to enter an interval formed between the reel 41 and the tape 42 and are wrapped around the periphery of the reel 41 layer upon layer. When the banknotes are required to be discharged, the tape 42 drives the reel 41 to rotate reversely, the banknotes are guided by the tape 42 to be discharged through the banknote conveying passage 2, and a flattening device 5 is arranged in the banknote conveying passage 2, and the flattening device 5 is used for flattening the curved banknotes.

First Embodiment

Figure 2:
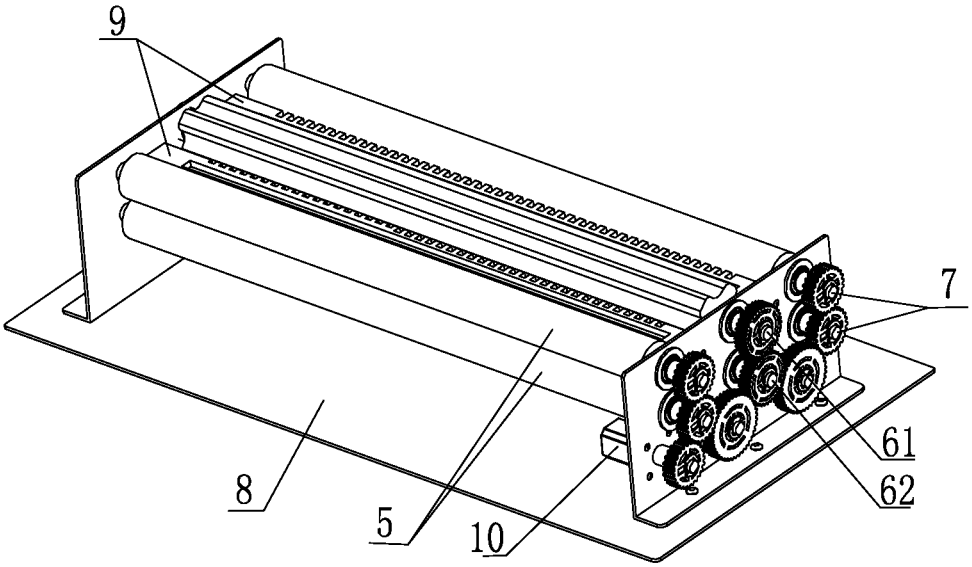
FIG. 2 is a schematic view showing a flattening device according to the present application.
Figure 3:
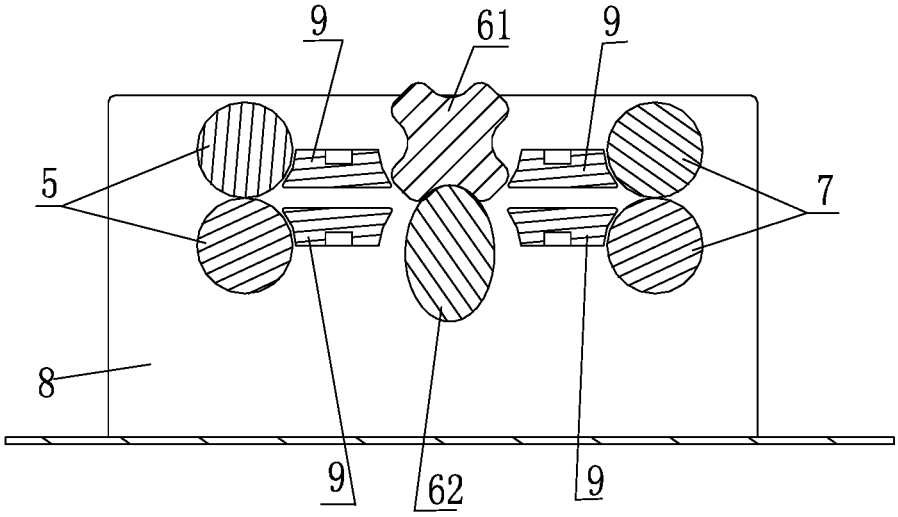
FIG. 3 is a sectional view showing the flattening device shown in FIG. 2.

In order to effectively flatten the banknotes discharged from the banknote storage box 4 shown in FIG. 1, a flattening device is provided according to the present application. Referring to FIGS. 2 and 3, the flattening device includes: a holder 8 configured to support the following components; at least one flattening roller set, including a first flattening roller 61 and a second flattening roller 62 arranged oppositely at two sides of a sheet medium conveying path; and a power mechanism 10 configured to drive the first flattening roller 61 and the second flattening roller 62 to rotate. A surface of the first flattening roller 61 is distributed with n arc-shaped grooves arranged in parallel with an axis direction of the first flattening roller 61, wherein n is a natural number greater than or equal to 1, and the n arc-shaped grooves are arranged on the surface of the first flattening roller with an interval of 360/n between each two adjacent grooves. In this embodiment, four arc-shaped grooves 601, 602, 603 and 604 are arranged on the first flattening roller 61. A surface of the second flattening roller 62 is provided with at least one arc-shaped protruding portion in rolling engagement with the arc-shaped grooves of the first flattening roller. The second flattening roller 62 in this embodiment is an oval-shaped roller having two arc-shaped protruding portions. Preferably, a depth of the arc-shaped groove in the surface of the first flattening roller 61 should not be less than a maximum curling amount of the curled banknotes, and a circular arc curvature of an oval long side of the oval-shaped second flattening roller 62 should not be greater than a curvature of the arc-shaped groove in the surface of the first flattening roller. Preferably, an arc-shaped concave surface of the first flattening roller 61 is always in cooperation with an outer cylindrical surface on the oval long side of the second flattening roller 62, and it is ensured that a top point of the arc-shaped groove in the surface of the first flattening roller 61 is in contact with a top point of the oval long side of the second flattening roller 62. The first flattening roller 61 and the second flattening roller 62 are in rolling engagement to form a conveying passage for the sheet medium. and.

In order to smoothly feed the banknotes into and output the banknotes from the conveying passage formed by the first flattening roller 61 and the second flattening roller 62 of the flattening roller set, a first guiding roller 5 and a second guiding roller 7 are arranged at two sides of the flattening roller set. A banknote guiding plate 9 is arranged between the flattening roller set and the first guiding roller 5, and another banknote guiding plate 9 is arranged between the flattening roller set and the second guiding roller 7. The first guiding roller 5 and the second guiding roller 7 are both composed of a pair of cylindrical rollers. The banknote guiding plate 9 is provided with a position sensor (not shown in the figures), and the position sensor controls the power mechanism by a control system, to allow a leading edge of the banknote to first come into contact with a portion, without the arc-shaped groove, of the first flattening roller 61 and to be clamped by this portion of the first flattening roller 61.

Figure 4:
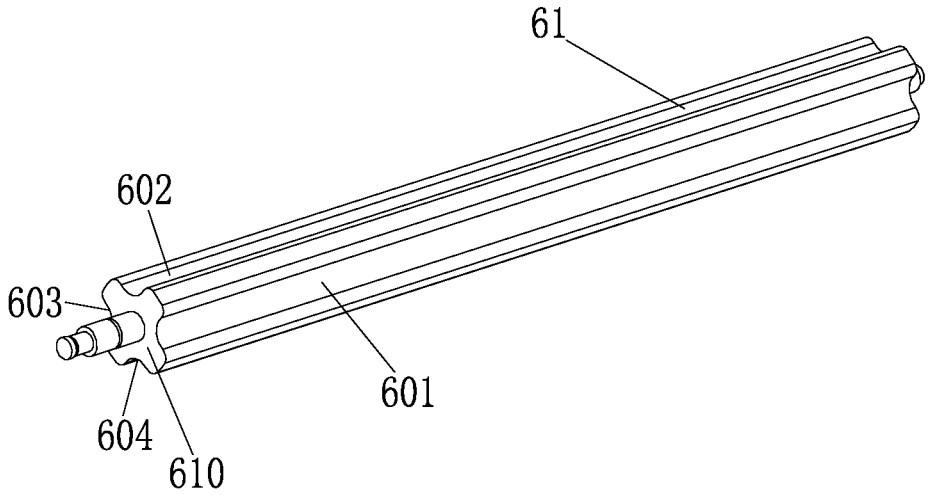
FIG. 4 is a schematic view showing the structure of a first flattening roller shown in FIG. 2.
Figure 5:
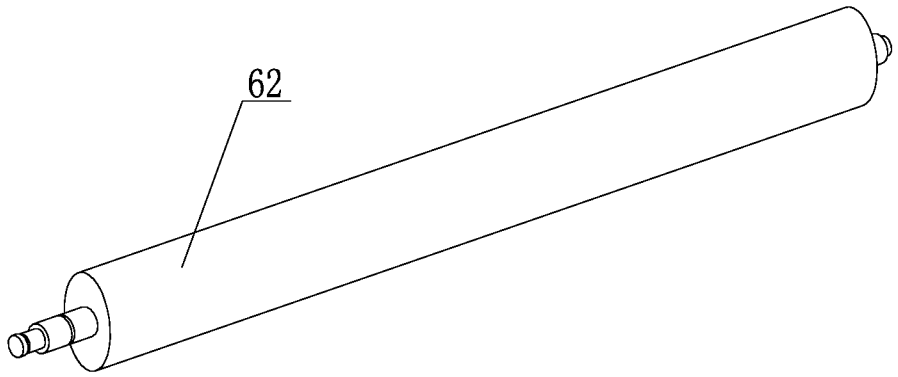
FIG. 5 is a schematic view showing the structure of a second flattening roller shown in FIG. 2.

Referring to FIGS. 4 and 5, in order to ensure that the first flattening roller 61 and the second flattening roller 62 will not damage the clamped banknotes, an outer layer of the first flattening roller 61 is a rubber layer, and an outer layer of the second flattening roller 62 is similarly wrapped by a rubber layer of a certain thickness.

Figure 6:
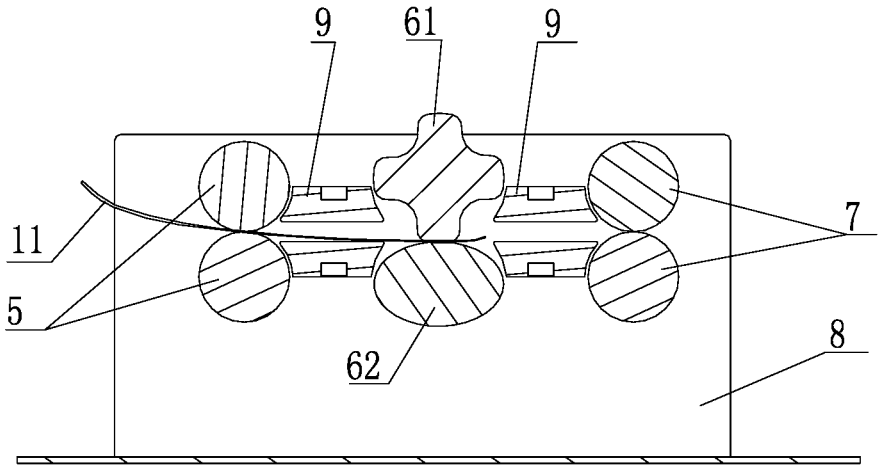
FIG. 6 is a schematic view showing an initial state of a process that the flattening device shown in FIG. 2 flattens curled banknotes.
Figure 7:
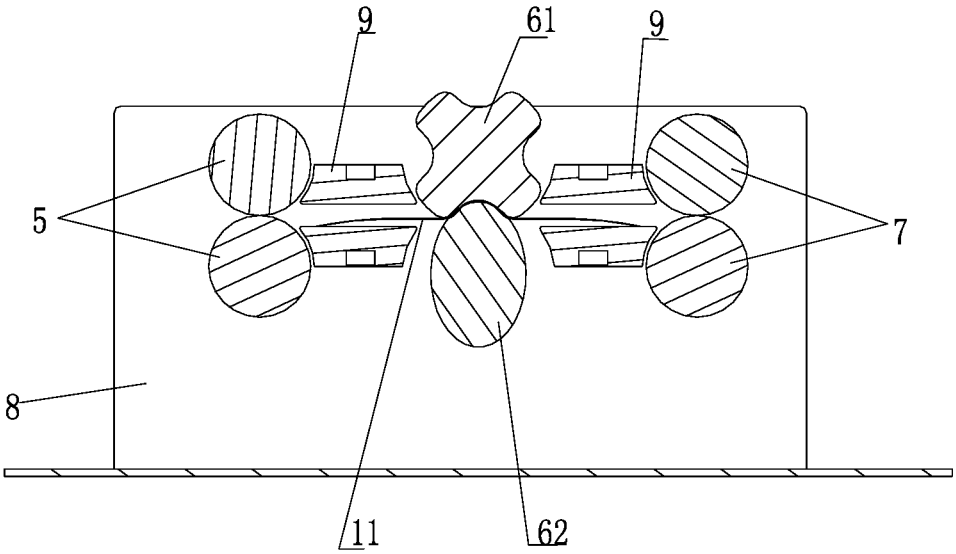
FIG. 7 is a schematic view showing the process that the flattening device shown in FIG. 2 flattens curled banknotes.

In order to further describe an operation process of the flattening device according to the present application, referring to FIGS. 6 and 7, when a to-be-flattened banknote 11 curled upward (a curled side is curled upward with respect to a middle portion of the banknote) enters from the first guiding roller 5 into the conveying passage formed by the first flattening roller 61 and the second flattening roller 62, a front end of the to-be-flattened banknote 11 comes into contact with the position sensor located on the banknote guiding plate 9 and triggers the position sensor, and position information of the to-be-flattened banknote 11 is transmitted to the power control system (not shown in the figures). The power control system controls a rotating speed of the power mechanism 10, and regulates a rotating speed and a phase position of the first flattening roller 61 and/or the second flattening roller 62. At this time, the front end of the banknote 11 is clamped by the outer cylindrical surface of the first flattening roller 61 and the outer surface on the oval long side of the second flattening roller 62, to be conveyed forward, and the grooves allow a position, having a largest curling degree, of the banknote (normally a middle position of the banknote) to be exactly clamped through a concave-convex cooperation formed by the arc-shaped groove of the first flattening roller 61 and the second flattening roller 62, which makes the position, having the largest curling degree, of the banknote generate a reverse bending deformation to a maximum degree, to achieve the flattening effect of the banknote. Meanwhile, the first flattening roller 61 and the second flattening roller 62 keep rotating, the banknote is clamped by the second guiding roller 7 to be discharged, and thus the flattening operation of the curled banknote 11 is completed.

In order to reliably flatten the curled banknotes, multiple sets of flattening roller sets may be arranged, or the depths of the grooves of the first flattening roller 61 may be deepened, or a curvature of the protruding portion of the second flattening roller 62 may be increased.

Through the cooperative control of the position sensor and the control system, the flattening device allows the position, having the largest curling degree, of the banknote to enter a concave-convex space formed by the first flattening roller 61 and the second flattening roller 62, and generate the reverse bending deformation to the maximum degree, to effectively reduce the curling degree of the banknote without effecting other positions of the banknote, and maintain the integrality of the banknote, thereby enhancing the reliability and stability of the financial self-service equipment in operations like banknote transmission, identification and stacking. The device is miniaturized, and it is not required to make major changes to the original financial self-service equipment, and the device can be arranged as a banknote conveying passage in a machine core.

Second Embodiment

Figure 8:
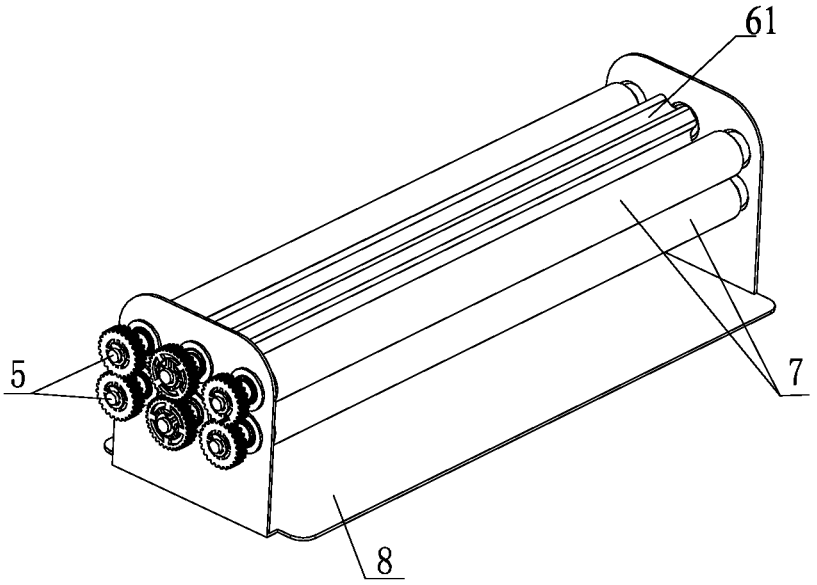
FIG. 8 is a schematic view showing another flattening device according to the present application.
Figure 9:
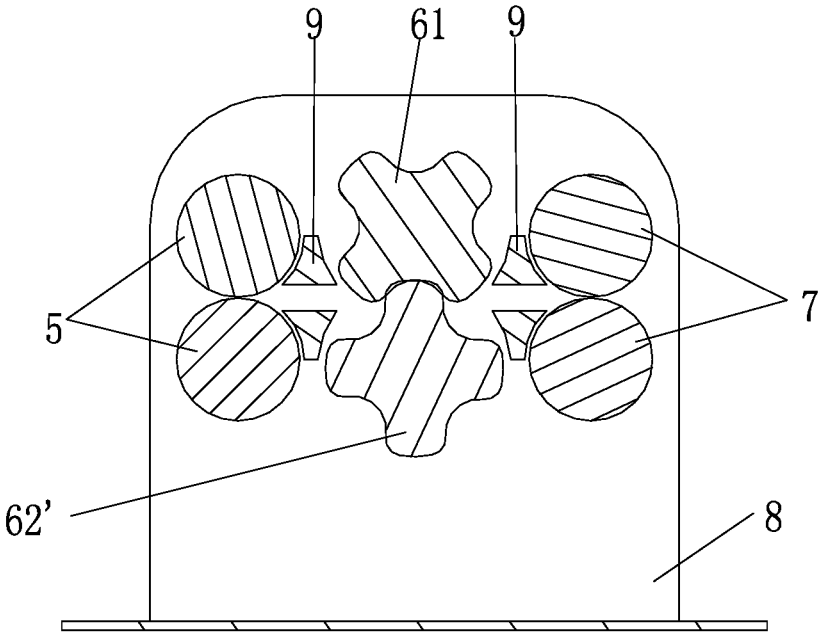
FIG. 9 is a sectional view showing the flattening device shown in FIG. 8.

Another preferable flattening device according to the present application is described hereinafter in conjunction with FIGS. 8 and 9. The flattening device includes: a holder 8 configured to support the following components; at least one flattening roller set, including a first flattening roller 61 and a second flattening roller 62' arranged oppositely at two sides of a sheet medium conveying path; and a power mechanism 10 configured to drive the first flattening roller 61 and the second flattening roller 62' to rotate. A surface of the first flattening roller 61 is distributed with n arc-shaped grooves arranged in parallel with an axis direction of the first flattening roller 61, wherein n is a natural number greater than or equal to 1, and the n arc-shaped grooves are arranged in the surface of the first flattening roller with an interval of 360/n between each two adjacent grooves. A surface of the second flattening roller 62' is provided with at least one arc-shaped protruding portion in rolling engagement with the arc-shaped grooves of the first flattening roller 61. In this embodiment shown in FIG. 10, the surface of the first flattening roller 61 is provided with four arc-shaped grooves 601, 602, 603 and 604, and the surface of the second flattening roller 62' is also provided with four arc-shaped grooves 601, 602, 603 and 604, and for each of the first flattening roller 61 and the second flattening roller 62', an arc-shaped protruding portion is formed between each two adjacent arc-shaped grooves in the four arc-shaped grooves, and the four arc-shaped groove form four of the arc-shaped protruding portions. Preferably, a depth of the arc-shaped groove in the surface of the first flattening roller 61 should not be less than a maximum curling amount of the curled banknotes, the arc-shaped concave surface of the first flattening roller 61 is always in cooperation with the convex surface of the second flattening roller 62' and the arc-shaped convex surface of the first flattening roller 61 is always in cooperation with the concave surface of the second flattening roller 62', and it is ensured that a highest point of the convex surface and a lowest point of the concave surface of each flattening roller are maintained to be tangent to each other. The first flattening roller 61 and the second flattening roller 62' are in rolling engagement to form a conveying passage for the banknotes.

In order to smoothly feed the banknotes into and output the banknotes from the conveying passage formed by the first flattening roller 61 and the second flattening roller 62 of the flattening roller set, a first guiding roller 5 and a second guiding roller 7 are arranged at two sides of the flattening roller set, a banknote guiding plate 9 is arranged between the flattening roller set and the first guiding roller 5, and another banknote guiding plate 9 is arranged between the flattening roller set and the second guiding roller 7. The first guiding roller 5 and the second guiding roller 7 are both composed of a pair of cylindrical rollers. Preferably, certain speed differences are maintained among the first guiding roller 5, the flattening rollers 61, 62' and the second guiding roller 7, that is, $V_{guiding\ roller\ 5}<V_{flattening\ rollers}<V_{guiding\ roller\ 7}$, besides, a center distance between the guiding rollers 5,7 and the flattening rollers 61, 62' should not be greater than a length of the banknote in the conveying direction, to ensure that the banknote can be clamped by the guiding rollers and the flattening rollers at the same time at a certain moment during the banknote conveying process.

Figure 10:
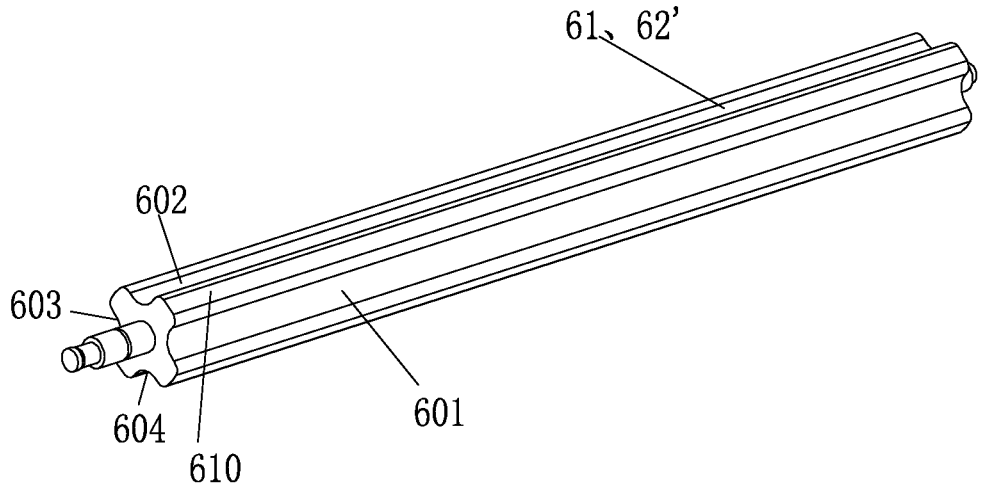
FIG. 10 is a schematic view showing structures of a first flattening roller and a second flattening roller shown in FIG. 8.

As shown in FIG. 10, in order to ensure that the first flattening roller 61 and the second flattening roller 62' will not damage the clamped banknotes, outer layers of the first flattening roller 61 and the second flattening roller 62' are rubber layers.

Figure 11:
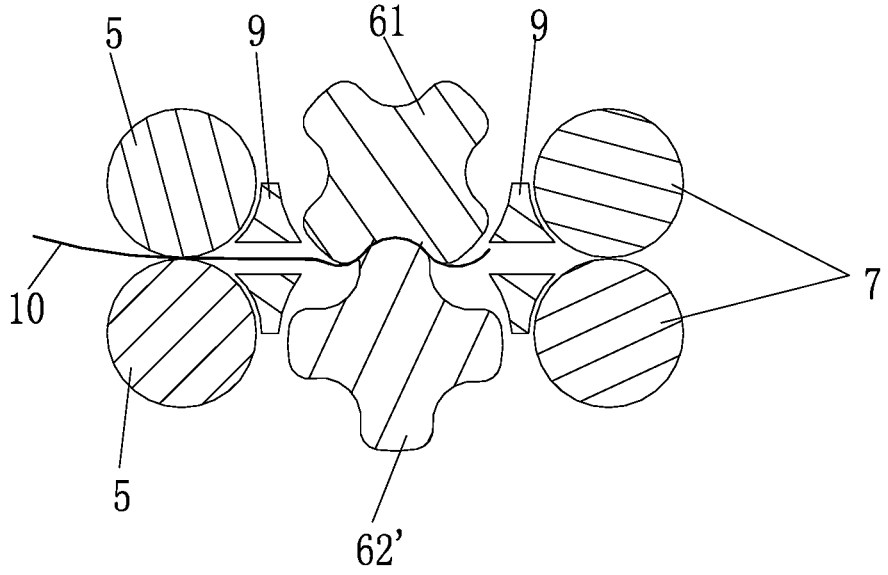
FIG. 11 is a schematic view showing an initial state of a process that the flattening device shown in FIG. 8 flattens curled banknotes.
Figure 12:
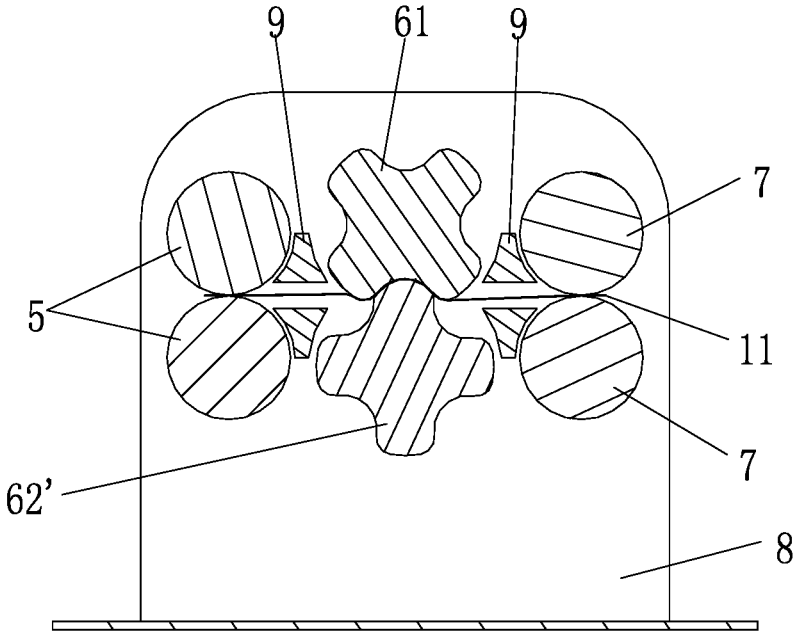
FIG. 12 is a schematic view showing the process that the flattening device shown in FIG. 8 flattens curled banknotes.

In order to further describe an operation process of the flattening device according to the present application, referring to FIGS. 11 and 12, when a curled banknote is fed in through the first guiding roller 5, because $V_{flattening\ rollers}>V_{guiding\ roller\ 5}$, a clamped part, between the first guiding roller 5 and the first flattening roller 61, of the banknote is stretched, and a preliminary flattening effect is achieved. The banknote 11 continues being conveyed downward, enters the position between the first flattening roller 61 and the second flattening roller 62', and due to the cooperation of the concave and convex arc-shaped surfaces of the two flattening rollers, the banknote 11 is pressed by the cooperation between the first flattening roller 61 and the second flattening roller 62', to form wave-shaped wrinkles having a curvature corresponding to the curvatures of the curved surfaces of the flattening rollers, as shown in FIG. 11, so that a degree of curling in a single direction of the curled banknote 11 is reduced, and the flattening effect is achieved. When the front end of the banknote 11 is sent to the second guiding roller 7, as shown in FIG. 12, because $V_{guiding\ roller\ 7} > V_{flattening\ rollers}$, a clamped part, between the second guiding roller 7 and the first flattening roller 61, of the banknote is stretched, thus on the one hand, a degree of concave and convex wrinkling on the surface of the banknote and the overall curling of the banknote are reduced; and on the other hand, the flattening processing performed by the second guiding roller 7 ensures an overall flattening effect of the curled banknote and reduces the possibility of the banknote rebounding.

Besides, in order to improve the flattening effect of the curled banknote, the number of the arc-shaped grooves in the outer cylindrical surface of the first flattening roller 61 of the flattening roller set may be increased, the curvatures of the concave and convex arc-shaped surfaces on the surfaces of the flattening rollers may be increased, multiple flattening roller sets may be increased, or speed differences between adjacent roller sets may be increased.

The banknote flattening device can be arranged as a banknote conveying passage at any position in the banknote conveying passage 2 of the financial self-service equipment as shown in FIG. 1, to realize the banknote flattening operation while completing banknote conveying process. Preferably, the flattening device is arranged at a position in the banknote conveying passage 2 near the banknote storage box 4.

The above described embodiments are only preferable embodiments of the present application. It should be noted that, the above preferable embodiments should not be construed as limitations to the present application, and the scope of protection of the present application is defined by the claims. For those skilled in the art, several improvements and modifications can be made without departing from the spirit and scope of the present application, and these improvements and modifications should also be deemed to fall within the scope of protection of the present application.

What is claimed is:

1. A flattening device, configured to flatten a sheet medium being input, comprising: a holder configured to support the following components; at least one flattening roller set, comprising a first flattening roller and a second flattening roller arranged oppositely at two sides of a sheet medium conveying path; and a power mechanism configured to drive the first flattening roller and the second flattening roller to rotate;

wherein a surface of the first flattening roller is distributed with n arc-shaped grooves arranged in parallel with an axis direction of the first flattening roller, wherein n is a natural number greater than or equal to 1, and a surface of the second flattening roller is provided with at least one arc-shaped protruding portion in rolling engagement with the arc-shaped grooves of the first flattening roller; and wherein, the first flattening roller and the second flattening roller are in rolling engagement to form a conveying passage for the sheet medium; and wherein, at least one side of two sides of the flattening roller set is provided with a conveying guide roller; and a preset differential value is provided between a surface linear velocity of the conveying guide roller and a surface linear velocity of the first flattening roller.

2. The flattening device according to claim 1, wherein a banknote guiding plate is arranged between the conveying guide roller and the flattening roller set.

3. A financial self-service equipment, comprising:

a banknote inlet/outlet for depositing and/or withdrawing banknotes;

a banknote storage box for storing and discharging banknotes; and a banknote conveying passage for connecting the banknote inlet/outlet and the banknote storage box and conveying banknotes;

wherein the flattening device according to claim 2 is arranged in the banknote conveying passage.

4. The flattening device according to claim 2, wherein the surface of the first flattening roller and/or the second flattening roller is covered with a rubber layer.

5. The flattening device according to claim 1, wherein the surface of the first flattening roller is provided with four of the arc-shaped grooves.

6. The flattening device according to claim 5, wherein the second flattening roller is an oval-shaped roller in rolling engagement with the surface of the first flattening roller.

7. A financial self-service equipment, comprising:

a banknote inlet/outlet for depositing and/or withdrawing banknotes;

a banknote storage box for storing and discharging banknotes; and a banknote conveying passage for connecting the banknote inlet/outlet and the banknote storage box and conveying banknotes;

wherein the flattening device according to claim 6 is arranged in the banknote conveying passage.

8. The flattening device according to claim 6, wherein the surface of the first flattening roller and/or the second flattening roller is covered with a rubber layer.

9. The flattening device according to claim 5, wherein the second flattening roller is provided with four of the arc-shaped protruding portions, and the four arc-shaped protruding portions are in rolling engagement with the four arc-shaped grooves on the surface of the first flattening roller, respectively.

10. A financial self-service equipment, comprising:

a banknote inlet/outlet for depositing and/or withdrawing banknotes;

a banknote storage box for storing and discharging banknotes; and a banknote conveying passage for connecting the banknote inlet/outlet and the banknote storage box and conveying banknotes;

wherein the flattening device according to claim 9 is arranged in the banknote conveying passage.

11. The flattening device according to claim 9, wherein the surface of the first flattening roller and/or the second flattening roller is covered with a rubber layer.

12. A financial self-service equipment, comprising:

a banknote inlet/outlet for depositing and/or withdrawing banknotes;

a banknote storage box for storing and discharging banknotes; and a banknote conveying passage for connecting the banknote inlet/outlet and the banknote storage box and conveying banknotes;

wherein the flattening device according to claim 5 is arranged in the banknote conveying passage.

13. The flattening device according to claim 5, wherein the surface of the first flattening roller and/or the second flattening roller is covered with a rubber layer.

14. The flattening device according to claim 1, wherein a depth of the arc-shaped groove in the surface of the first flattening roller is not be less than a maximum curling amount of the sheet medium.

15. The flattening device according to claim 1, wherein the surface of the first flattening roller and/or the second flattening roller is covered with a rubber layer.

16. A financial self-service equipment, comprising:

a banknote inlet/outlet for depositing and/or withdrawing banknotes;

a banknote storage box for storing and discharging banknotes; and a banknote conveying passage for connecting the banknote inlet/outlet and the banknote storage box and conveying banknotes;

wherein the flattening device according to claim 1 is arranged in the banknote conveying passage.

* * * * *